United States Patent [19]

Ohnuma et al.

[11] 4,194,830

[45] Mar. 25, 1980

[54] DEVELOPMENT APPARATUS

[75] Inventors: Teruyuki Ohnuma, Yokohama; Kaoru Shimizu, Tokyo; Seiichi Miyakawa, Nagareyama; Hajime Oyama, Tokyo, all of Japan

[73] Assignee: Ricoh Company, Ltd., Tokyo, Japan

[21] Appl. No.: 946,384

[22] Filed: Sep. 26, 1978

[30] Foreign Application Priority Data

Sep. 30, 1977 [JP] Japan ..... 52-118174

[51] Int. Cl.[2] ..... G03G 15/00

[52] U.S. Cl. ..... 355/3 DD; 118/656; 118/661

[58] Field of Search ..... 355/3 R, 3 DD; 118/653, 118/656, 661

[56] References Cited

U.S. PATENT DOCUMENTS

| | | | |
|---|---|---|---|
| 3,909,258 | 9/1975 | Kotz | 96/1 R |
| 4,081,571 | 3/1978 | Nishihama et al. | 355/3 DD X |
| 4,114,261 | 9/1978 | Weiler | 355/3 DD X |
| 4,116,555 | 9/1978 | Young et al. | 355/3 DD X |

*Primary Examiner*—Fred L. Braun

*Attorney, Agent, or Firm*—Cooper, Dunham, Clark, Griffin & Moran

[57] ABSTRACT

A development apparatus for developing a latent electrostatic image formed on a photoconductor with a one-component type developer has a charging device comprising at least two charging members for charging the developer held in a developer container. The first charging member serves both as a doctor blade and for regulating the amount of the developer on the development roller, and the second charging member charges the developer before it is charged by the first charging member. In the second charging member, there is formed a hole for allowing the developer to pass therethrough. The developer scraped by the first charging member is returned to the developer container through the hole and part of the scraped developer is carried back to the first charging member, so that a developer circulation path is formed in the charging device. While passing through the developer circulation path, the developer is charged further, whereby the developer is sufficiently charged before it is actually used for development.

9 Claims, 8 Drawing Figures

DEVELOPMENT APPARATUS

BACKGROUND OF THE INVENTION

The present invention relates to a development apparatus for developing latent electrostatic images formed in electrophotographic copying apparatus employing a one-component type developer.

The development method employing a one-component type developer has an advantage in that it does not necessitate a toner concentration detecting apparatus for maintaining a mixing ratio of toner and carriers as in the case of the development method employing a two-component developer. Therefore, the former method is advantageously used in inexpensive copying machines or copying machines which require minimum maintenance. Development method used with one-component type developers can be classified into two types. One is the type in which a low resistivity developer is employed, and the other is the type in which a high resistivity developer is employed. These two types are different in the development process. In the first type employing a low resistivity developer (hereinafter referred to as a low resistivity toner), the toner itself is not charged and accordingly, by use of a conductive rotary cylinder having a magnet therein, an electrically conductive path is formed between the photoconductor and the rotary cylinder through the toner, so that an electric charge, which is opposite in polarity to that of the latent electrostatic image formed on the photoconductor, is induced on the toner, whereby the latent electrostatic image is developed. However, this process has a disadvantage in that a finite time is required to induce an electric charge on the toner and the time cannot be reduced below certain limits. Accordingly, it is not suitable for high speed development and electrostatic transfer of a toner image by this process is difficult.

In the type employing a high resistivity toner, there are many variations. FIG. 1 shows one representative method of such type. In the figure, reference numeral 1 represents a photoconductor on which a latent electrostatic image is formed. There is a small gap maintained between the photoconductor 1, and the development roller 2, which is rotated in the direction of the arrow. Above the developer roller 2, there is situated a hopper 4 in which a toner 3 is held. As the development roller 2 is rotated, a necessary amount of the toner 3 is replenished from the hopper 4 to the development roller 2. The toner 3 carried out of the hopper 4 is triboelectrically charged to a polarity opposite to that of a latent electrostatic image by a triboelectric charging blade 5 which is in pressure contact with the surface of the development roller 2. The thus triboelectrically charged toner is then transported to a development station A. After development, the toner remaining on the surface of the development roller 2 is caused to pass through the hopper 4 again, to which a fresh toner 3 is added. The movement of the toner 3 is repeated within the hopper 4. In this case, however, the toner particles of the toner 3 are triboelectrically charged in contact with each other, so that each toner particle acquires a different polarity. As a result the toner particles electrostatically aggregate. Furthermore, since the toner placed in the hopper 4 is not electrically charged at all, it cannot be sufficiently charged by the triboelectric charging blade 5 when the toner 3 is replenished from the hopper 4 to the development roller 2 and is then triboelectrically charged by the triboelectric charging blade 5. In other words, even if a high resistivity toner is triboelectrically charged, it cannot be charged speedily and sufficiently in the conventional process. In order to solve this problem, a number of triboelectric charging blades can be employed. However, when a plurality of blades are employed, the toner layer on the development roller 2 cannot be made thick enough with the result that the image density cannot be sufficiently raised. Furthermore, this method has the disadvantage that only the superficial portion of the toner layer on the development roller 2 is charged.

SUMMARY OF THE INVENTION

It is therefore a primary object of the present invention to provide a development apparatus for developing latent electrostatic images with a one-component type-developer, which is capable of charging the one-component type developer sufficiently.

In order to attain this object, in the present invention, the developer is charged by at least two charging members. Accordingly, toner deposition on the background of a copy and poor reproduction of a low contrast original image, due to an insufficient charging of the toner, are completely obviated. Of the two charging members, the first charging member serves as a doctor blade and to regulate the thickness of the toner layer on a development roller, and the second charging member charges not only a fresh toner in a toner hopper, but also the toner scraped by the first charging member again. Since the second charging member has a hole therein for allowing the toner to pass therethrough, the toner scraped by the first charging member is returned to the toner hopper through this hole, and then carried back to the first charging member. This assures sufficient charging of the toner. Thus, the toner in the hopper is charged uniformly to one polarity. Therefore, the aggregation of the toner particles which may be caused by the electric charges in opposite polarity of the toner particles is prevented.

Furthermore, since the toner layer deposited on a sleeve of the development roller or on an endless belt which is employed as a means for supplying the toner to the photoconductor is charged thoroughly, the image density can be raised sufficiently for good development. Furthermore, there is no requirement for the toner layer to be reduced in thickness as in the case of the conventional method.

In one embodiment of a development apparatus according to the present invention, a rotary means is provided for promoting the circulation of the toner when the toner scraped by the first charging member is returned to the toner hopper, thereby the charging efficiency of the toner is raised and the circulation load of the toner is lessened.

DETAILED DESCRIPTION OF THE PREFERRED EMBODIMENTS

Figure 1:
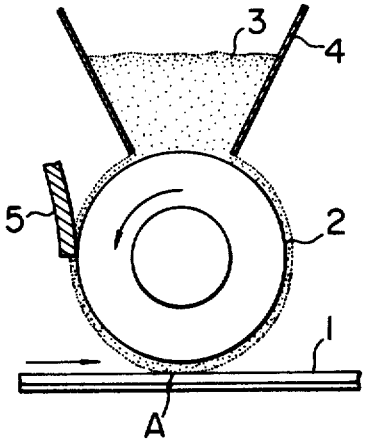
FIG. 1 PRIOR ART
FIG. 1 is a schematic sectional side view of the conventional development apparatus.
Figure 2:
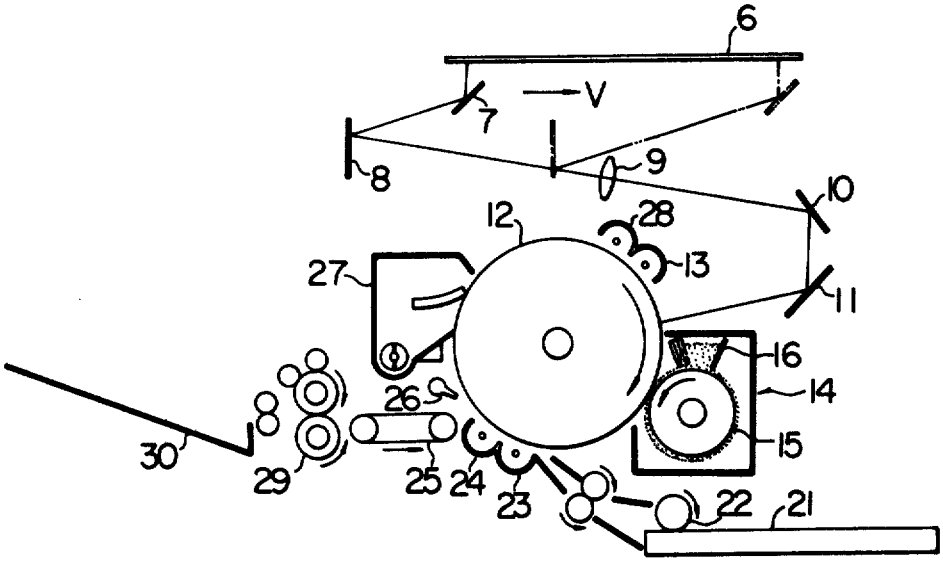
FIG. 2 is a schematic sectional side view of an electrophotographic copying apparatus in which one embodiment of a development according to the present invention can be employed.

Referring to FIG. 2, there is schematically shown an embodiment of a development apparatus according to the present invention. In the figure, under a contact glass 6, there are disposed a first movable reflector 7 and a second movable reflector 8, which move in the direction of the arrow parallel to the contact glass 6 at a speed ratio of 1:0.5, so that an original document placed on the contact glass 6 is scanned while illuminated. A light image from the original document is projected on a photoconductor drum 12 through a lens 9, a stationary third reflector 10 and a stationary fourth reflector 11. The photoconductor drum 12 is rotated at a predetermined speed in the direction of the arrow and the peripheral surface of the photoconductor drum 12 is uniformly charged by a charger 13. A latent electrostatic image is formed on the photoconductor drum 12 by the projection of the light image of the original document. The thus formed electrostatic image is then developed by a development apparatus 14. The development apparatus 14 comprises a development roller 15 and a hopper 16 for supplying a one-component type developer (hereafter simply referred to as "the toner") to the development roller 15. The toner supplied to the development roller 15 from the hopper 16 is electrically charged to a predetermined polarity and then brought into contact with the surface of the photoconductor drum 12.

Figure 3:
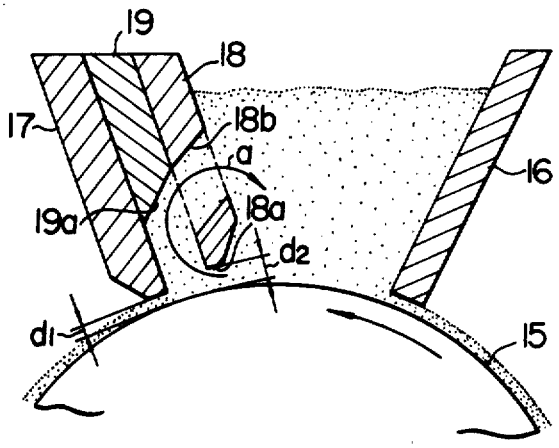
FIG. 3 is an enlarged partial sectional side view of the development apparatus of FIG. 2.

FIG. 3 more specifically illustrates the supplying and the charging of the toner. If a toner is non-magnetic, the development roller 15 made of such a material such as silicone rubber to which the toner tends to cling is employed. If the toner is magnetic, the development roller 15 comprises a non-magnetic sleeve with an internally disposed magnet, or a magnetic roller. Above the development roller 15, there is situated the hopper 16. On the outlet side of the hopper 16, there are disposed a first triboelectric charging member 17, a second triboelectric charging member 18 disposed on an inner side of the first triboelectric charging member 17, with a support member 19 therebetween. The first triboelectric charging member 17 and the second triboelectric charging member 18 are made of materials different in triboelectric series from that of the toner.

Depending upon the polarity to which the toner is charged, the position in triboelectric series of the material of the triboelectric charging members 17 and 18 is determined. For instance, when the toner comprises epoxy resin, teflon is employed as the material for use in the triboelectric charging members 17 and 18, and when the toner comprises phenolic resin, nylon is employed as the material for use in the triboelectric charging members 17 and 18. Metals also can be employed as the material for use in the charging members 17 and 18, and both with and without an applied potential.

A gap $d_1$ between the first triboelectric charging member 17 and the surface of the development roller 15 is set smaller than a gap $d_2$ between the second triboelectric charging member 18 and the surface of the development roller 15. The gap $d_1$ is set, for instance, at approximately 0.05 mm.

Figure 4:
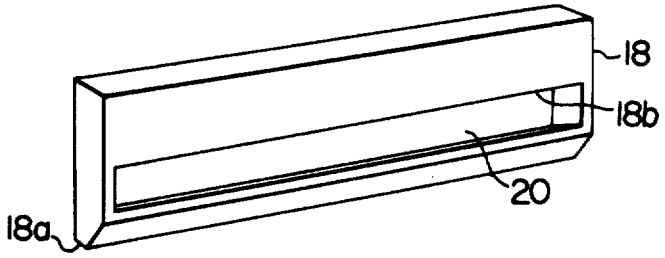
FIG. 4 is a perspective view of a second charging member for use in one embodiment of a development apparatus according to the present invention.

As shown in FIG. 4, a rectangular long and narrow hole 20 is formed in a central and lower portion of the second triboelectric charging member 18. The support member 19 is disposed in such a manner that an end surface 19*a* of the support member 19 is contiguous with to an upper surface 18*b* of the hole 20 of the second triboelectric charging member 18, whereby excessive toner on the development roller 15 accumulated by the first triboelectric charging member 17 is returned to the hopper 16, passing through a toner circulation path formed by an inner side of the first triboelectric charging member 17 and the hole 20. Thus, the toner moves in the direction of the arrow a through the toner circulation path.

The toner held in the hopper 16 is transported to a development station by the rotation of the development roller 15. During this transportation, the toner is first triboelectrically charged by a tip portion 18*a* of the second triboelectric charging member 18 and is then triboelectrically charged further by the first triboelectric charging member 17. The first triboelectric charging member 17 also serves as a doctor blade for regulating the amount of the toner on the development roller 15. The excess toner collected by the first triboelectric charging member 17 is returned to the hopper 16 through the previously mentioned toner circulation path. At this moment, the toner acquires a slight additional triboelectric charge by contact with the second triboelectric charging member 18. Thereafter, such charging of the toner is repeated so that all the toner in the hopper 16 is gradually and uniformly charged. Therefore, the toner which comes from the first triboelectric charging member 17 has a sufficiently high charge. It is necessary to cause the toner to circulate in this manner to charge the toner preliminarily. The relationship between the gap $d_1$ of the first triboelectric charging member 17 and the gap $d_2$ of the second triboelectric charging member 18, that is very important. The value of $d_1$ must be less than $d_2$ for maximum efficiency.

The photoconductor drum 12 having a developed toner image thereon is brought into close contact with a transfer sheet fed from a sheet cassette 21 by a sheet feed roller 22. In an image transfer station, corona charge is applied to the back side of the transfer sheet by a corona transfer apparatus 23 so that the toner image is electrostatically transferred to the transfer sheet from the surface of the photoconductor 12.

By quenching corona charger apparatus 24 comprising an a.c. corona charger or the like, electric charges on the transfer sheet are neutralized, the transfer sheet is separated from the photoconductor drum 12 and is then transported onto a transfer belt 25. In order to separate the transfer sheet from the photoconductor drum 12 efficiently, an air pick-off apparatus 26 is provided, which blasts compressed air against the leading edge of each transfer sheet, with the blasting timed to the transportation of each transfer sheet.

After image transfer, the toner remaining on the photoconductor drum 12 is removed from the surface of the photoconductor drum 12 by a blade cleaning apparatus 27. The thus cleaned photoconductor drum 12 is quenched by a quenching apparatus 28. In the meantime, the transfer sheet is caused to pass through a heat fixing roller apparatus 29, where the toner image is fixed permanently to the transfer sheet and the transfer sheet is discharged face-up onto a sheet discharge tray 30. Thus, one copying cycle is completed.

Figure 5:
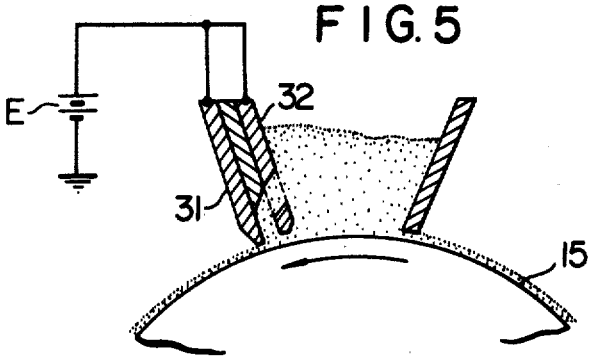
FIG. 5 is a schematic sectional side view of another embodiment of a development according to the present invention.

Referring to FIG. 5, there is shown another embodiment of a development apparatus according to the present invention, in which a first charging member 31 and a second charging member 32 made of an electrically conductive material are provided instead of the first triboelectric charging member 17 and the second triboelectric charging member 18 as in FIG. 3. The first charging member 31 also serves as a doctor blade for regulating the amount of the toner on the development roller 15. To the first charging member 31 and the second charging member 32, a potential is applied by an outer power source E, whereby when the toner passes under the two charging members 31 and 32, electric charges are injected into the toner or applied to the toner by discharging, so that the toner is charged to a positive polarity. The other elements are the same as those in FIG. 3.

Figure 6:
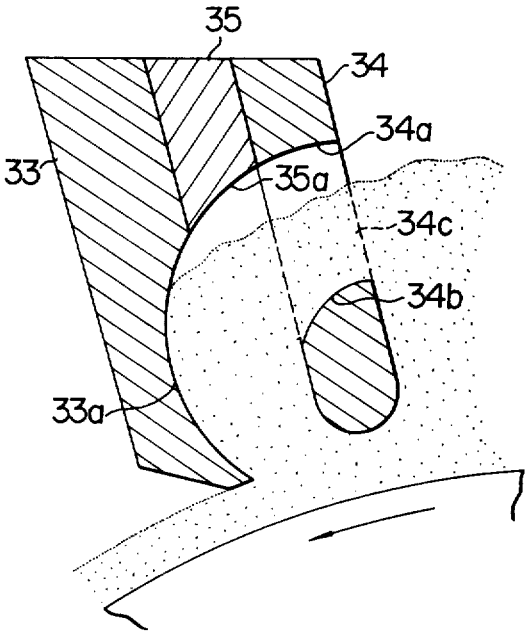
FIG. 6 is a schematic sectional side view of a further embodiment of a development apparatus according to the present invention.

Referring to FIG. 6, there is shown an improved charging apparatus for use in the present invention. In this charging apparatus, a toner circulation path is improved in such a manner that the toner can be moved smoothly through the toner circulation path by minimizing the load to be put on the toner. To be more specific, a surface 33*a* of the first charging member 33 and a surface of the second charging member 34 and a lower surface 35*a* of a support member 35, which face the toner circulation path, are made in the form of a continuous smooth curved surface. A lower surface 34*b* of a long hole 34*c* of the second charging member 34 is also curved so that the toner flows smoothly along the surface 34*b*.

Figure 7:
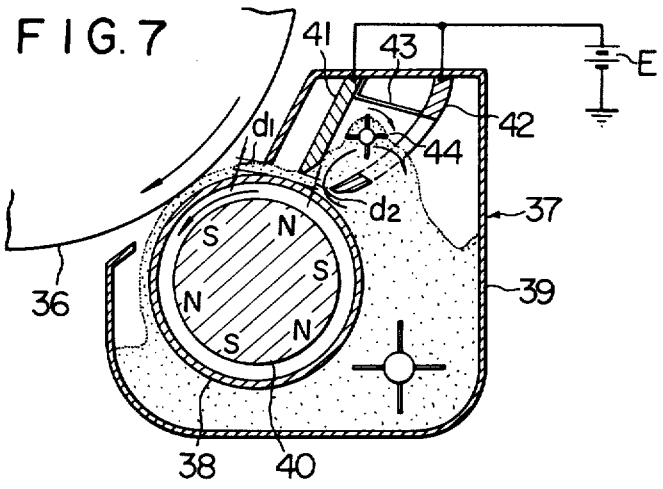
FIG. 7 is a schematic sectional side view of a further embodiment of a development apparatus according to the present invention.

Referring to FIG. 7, there is shown a further embodiment of a development apparatus according to the present invention. In the figure, a photoconductor drum 36 is rotated in the direction of the arrow and a development apparatus 37 is disposed in a position where the peripheral surface of the photoconductor drum 36 is moved downwards. The development apparatus 37 holds a one-component type magnetic toner therein and comprises a non-magnetic rotary sleeve 38 and a toner container 39 for supplying the magnetic toner therefrom to the non-magnetic rotary sleeve 38. Inside the non-magnetic rotary sleeve 38, there is disposed a magnetic roller 40 which is alternately magnetized to negative and positive polarity. The magnetic toller 40 can be designed to be rotatable. In this case, the sleeve 38 can be designed to be rotatable or stationary. Instead of the magnetic roller 40, a permanent magnet can be disposed inside the sleeve 38. The sleeve 38 is disposed adjacent the photoconductor drum 36 and a part of the sleeve 38 is submerged in the magnetic toner held in the toner container 39. As the sleeve 38 is rotated, the magnetic toner is magnetically attracted to the surface of the sleeve 38 and brought upwards. Above the sleeve 38, there is situated a first charging member 41 with a gap $d_1$ maintained from the surface of the sleeve 38. Upstream of the toner path on the sleeve 38, viewed from the first charging member 41, there is disposed a second charging member 42, adjacent the first charging member 41, with a gap $d_2$ from the surface of the sleeve 38. Here, the gap $d_1$ is set smaller than the gap $d_2$. The first charging member 41 and the second charging member 42 are made of an electrically conductive material and are connected to a d.c. power source E for applying a voltage thereto in a polarity opposite to that of a latent electrostatic image on the photoconductive drum 36. The magnetic toner on the sleeve 38 is first charged by the second charging member 42 and the movement of an excessive magnetic toner is hindered by the first charging member 41. The first charging member 41 serves as a doctor blade for regulating the amount of the toner to be supplied to the photoconductor drum 36. A predetermined amount of the magnetic toner regulated by the first charging member 41 is further charged by the first charing member 41 so that the magnetic toner is sufficiently charged and magnetically transported to a development station. As shown in FIG. 4, a long hole is made in the second charging member 42, so that a toner circulation path is formed by the long hole and a support plate 43 bridged between the first charging member 41 and the second charging member 42. In this toner circulation path, there is disposed an impeller 44 which rotates in the direction of the arrow. The impeller 44 helps the magnetic toner scraped by the first charging member 41 return to the toner container 39 through the hole of the second charging member 42. Any type of impeller can be employed so long as it can move the toner powder in the direction normal to its rotary shaft, but it is necessary that the impeller 41 be made of a material on which the toner will not deposit. For example, the impeller 44 can be made of a non-magnetic material or such a non-magnetic material as can triboelectrically charge the toner to an opposite polarity from that of a latent image by use of a motion of the impeller 44 relative to the magnetic toner, while is contact with each other. The rotating direction of the impeller 44 is determined in accordance with a location of the impeller 44. The number of the impellers is not limited to one as in the embodiment illustrated in FIG. 7. Furthermore, an impeller which stirs the magnetic toner in its own axial direction when the toner passes through is more effective in charging the toner.

Figure 8:
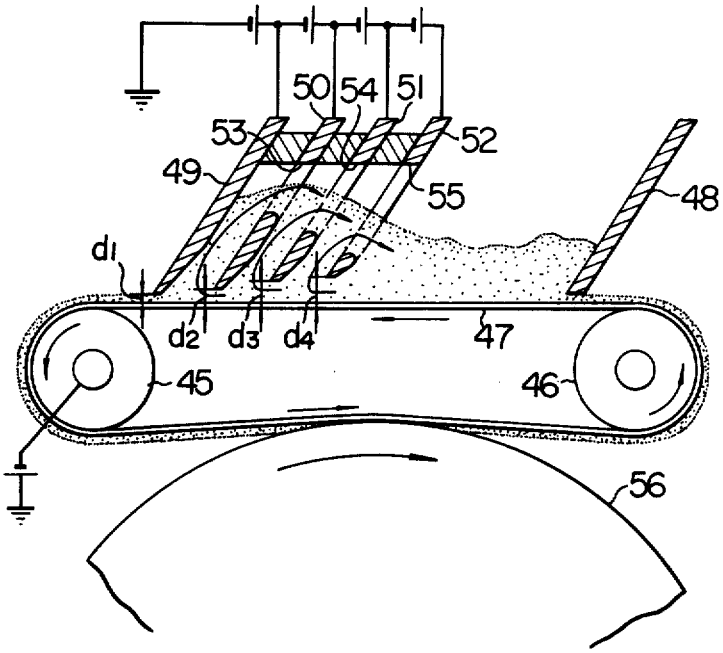
FIG. 8 is a schematic sectional side view of a further embodiment of a development apparatus according to the present invention.

Referring to FIG. 8, there is shown a further embodiment of a development apparatus according to the present invention. This embodiment is characterized in that a plurality of charging members are provided. A flexible endless belt 47, made of an electrically conductive material such as silicone rubber, is trained over a pair of rollers 45 and 46, and is rotated in the direction of the arrow by the roller 45 being driven by a driving apparatus (not shown), so that the upper portion of the endless belt 47 is under tension and the toner supplying portion and electrically charging portion of the belt 47 are made as flat as possible.

Above the endless belt 47, there is situated a hopper 48 in which a one-component type non-magnetic toner is held. At an outlet of the hopper 48, there is disposed a first charging member 49, and inside the first charging member 48, there are disposed three charging elements 50, 51 and 52, with predetermined spaces between each pair. The three charging elements 50, 51 and 52 are collectively referred to as a second charging member. The respective gaps between the endless belt 47 and the respective tips of the charging members 49, 50, 51 and 52 are $d_1$, $d_2$, $d_3$, and $d_4$, where $d_1 < d_2 < d_3 \leq d_4$. The respective charging elements 50, 51 and 52 of the second charging member are formed as shown in FIG. 4, and the respective long holes 53, 54 and 55 are formed with dimensions in inverse order of gap size so that a toner circulation path is formed in which the holes forming a portion thereof are gradually narrowed in the direction of the path of the developer supplying means. In FIG. 8, the first charging member 49 and the second charging member are disposed parallel to each other and are slanted with respect to the endless belt 47. However, the construction of the first charging member 49 and the second charging member is not limited to such a construction as shown in FIG. 8. The first charging member 49 and the charging elements 50, 51 and 52 of the second charging member are made of an electrically conductive material, and a predetermined voltage is applied to each member. Instead of these charging members 49 to 52, a no-voltage-applied doctor blade capable of charging the tower triboelectrically can be employed. The toner supplied from the hopper 48 to the endless belt 47 is first charged by the charging element 52 and then by the charging element 51.

In this construction a large amount of the toner is directed in the direction of the arrows, through the toner circulation path, and is returned to the hopper 48. The charged toner is further charged by the charging element 50 and an excessive amount of the toner is returned likewise to the hopper 48. The first charging member 49 is for the final regulation of the amount of toner, and also for effecting a sufficient charge. The thus charged toner is then transported to the development section. The toner scraped by the charging member 49 and the charging elements 50 and 51 is returned to the hopper 48 through the toner circulation path. Since the thus returned toner is sufficiently charged, when it is transported by the endless belt 47, it is still sufficiently charged.

The thus charged toner is brought into contact with the surface of a photoconductor drum or electrostatic recording drum 56 at a lower portion of the endless belt 47 so that a latent electrostatic image formed on the photoconductor drum 56 is developed. During the development process, a bias voltage is applied to the endless belt 47 by connecting the roller 45 to a power source in order to prevent toner deposition on the background of a copy and to control the image density.

As in the case of FIG. 7, an impeller can also be disposed in the toner circulation path.

In all of the above-mentioned embodiments of the present invention a conductive charging member and a triboelectric charging member can be employed in combinaton, if desired.

While specific embodiments of the invention have been shown and described in detail to illustrate the application of the principles of the invention, it will be understood that the invention may be embodied otherwise without departing from such principles.

What is claimed is:

1. In a development apparatus for developing a latent electrostatic image comprising a developer supplying means for supplying a one-component type developer to a latent electrostatic image bearing photoconductor, said developer supplying means being rotatable and bearing said one-component type developer thereon, a developer replenishing means for replenishing said one-component type developer to said developer supplying means, and a charging means for electrically charging said one-component type developer on said developer supplying means, the improvement comprising a first charging member for charging said one-component type developer, disposed at an outlet of said developer replenishing means and adjacent said developer supplying means, and at least one second charging member, which is disposed on an inner side of said first charging member and in which a hole is formed, said first charging member, second charging member, and developer supplying means forming a circulation path for return of excess developer to said developer replenishing means.

2. A development apparatus as claimed in claim 1, wherein said first charging member serves as doctor blade means for regulating the amount of said one-component type developer on said developer supplying means to be supplied to said latent electrostatic image.

3. A development apparatus as claimed in claim 1, wherein said first charging member and said second charging member are disposed in such a manner that the respective gaps formed between said developer supplying means and said charging members are gradually narrowed in the direction of developer transportation along said developer supplying means.

4. A development apparatus as claimed in claim 1, further comprising a rotating means for promoting movement of said one-component type developer in said developer circulation path.

5. A development apparatus as claimed in claim 1, wherein said first charging member and said second charging member are made of material which is different in triboelectric series from said one-component type developer.

6. A development apparatus as claimed in claim 1, wherein said first changing member and said second charging member are made of electrically conductive material.

7. A development apparatus as claimed in claim 1, wherein of said first charging member and said second charging member, one is a triboelectric charging member and the other is a conductive charging member.

8. A development apparatus as claimed in claim 3, wherein said second charging member comprises a plurality of charging elements, each of which has a hole forming a portion of said toner circulation path, and whose respective gaps from said developer supplying means are gradually narrowed in the direction of developer transportation along said developer supplying means.

9. A development apparatus as claimed in claim 6, wherein a potential is applied to at least one member of said first charging member and said second charging member.

* * * * *